US009704360B2

(12) United States Patent
O'Brien et al.

(10) Patent No.: US 9,704,360 B2
(45) Date of Patent: Jul. 11, 2017

(54) OCCUPANCY-SENSOR WIRELESS-SECURITY AND LIGHTING-CONTROL

(71) Applicant: OWL Enterprises, LLC, Issaquah, WA (US)

(72) Inventors: Michael O'Brien, Bellevue, WA (US); Rocco Terry, Sammamish, WA (US); Donald Small, Oakland, CA (US)

(73) Assignee: OWL ENTERPRISES, LLC, Issaquah, WA (US)

( * ) Notice: Subject to any disclaimer, the term of this patent is extended or adjusted under 35 U.S.C. 154(b) by 558 days.

(21) Appl. No.: 14/211,293

(22) Filed: Mar. 14, 2014

(65) Prior Publication Data

US 2014/0265633 A1 Sep. 18, 2014

Related U.S. Application Data

(60) Provisional application No. 61/799,285, filed on Mar. 15, 2013.

(51) Int. Cl.

| | |
|---|---|
| ***G08B 13/19*** | (2006.01) |
| *G08B 13/16* | (2006.01) |
| *G08B 13/196* | (2006.01) |
| *G08B 25/10* | (2006.01) |

(52) U.S. Cl.

CPC ..... *G08B 13/19* (2013.01); *G08B 13/1645* (2013.01); *G08B 13/19697* (2013.01); *G08B 25/10* (2013.01); *Y10T 307/766* (2015.04)

(58) Field of Classification Search

CPC ..... G08B 13/19; G08B 25/10; Y10T 307/766

See application file for complete search history.

(56) References Cited

U.S. PATENT DOCUMENTS

| | | | | |
|---|---|---|---|---|
| 7,880,393 | B2 * | 2/2011 | Wong | G06F 1/3203 315/149 |
| 2003/0016129 | A1 * | 1/2003 | Menard | G08B 25/008 340/531 |
| 2006/0000971 | A1 * | 1/2006 | Jones | G08B 25/00 250/239 |
| 2008/0303661 | A1 * | 12/2008 | Chick | G08B 13/19 340/541 |

* cited by examiner

*Primary Examiner* — Jeffrey Shin

(74) *Attorney, Agent, or Firm* — Amin, Turocy & Watson, LLP

(57) ABSTRACT

Integrating a direct current (DC) voltage motion sensing alarm with an alternating current (AC) voltage light source is presented herein. An apparatus can include a voltage conversion component that generates, within a wall switch box, a DC voltage from an AC voltage that is higher in magnitude than the DC voltage, and a motion sensing component that detects, from the wall switch box using the DC voltage, a motion of an object. The motion sensing component can detect the motion using an infrared and/or ultrasonic based DC sensor. The apparatus can further include a security component that generates, from the wall switch box using the DC voltage, an alarm signal and/or wireless alarm signal based on the motion, and a power component that switches, from the wall switch box using the DC voltage based on the motion, the AC voltage from a first contact to a second contact.

20 Claims, 13 Drawing Sheets

OCCUPANCY-SENSOR WIRELESS-SECURITY AND LIGHTING-CONTROL

PRIORITY CLAIM

This application claims priority to U.S. Provisional Patent Application No. 61/799,285, filed on Mar. 15, 2013, entitled "OCCUPANCY SENSOR/WIRELESS ALARM UNIT", the entirety of which is incorporated by reference herein.

BACKGROUND

Lighting-control systems utilize sensors placed in buildings for energy management. Further, security systems utilize other sensors placed in buildings for motion detection. However, conventional light control and motion sensing technologies have had some drawbacks that will be appreciated with reference to the various embodiments described herein below.

BRIEF DESCRIPTION OF THE DRAWINGS

Non-limiting embodiments of the subject disclosure are described with reference to the following figures, wherein like reference numerals refer to like parts throughout the various views unless otherwise specified.

DETAILED DESCRIPTION

Figure 1:
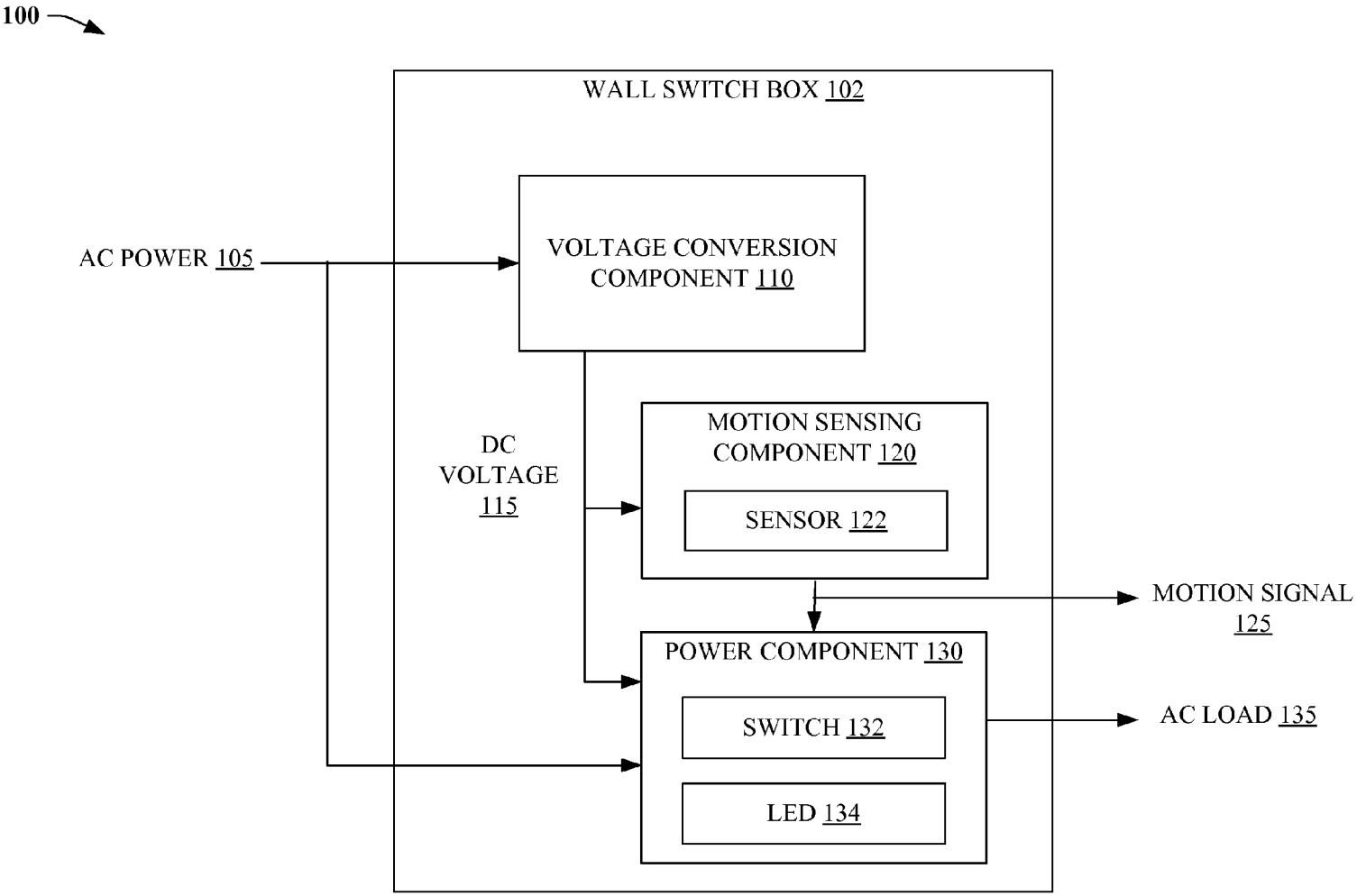
FIG. 1 illustrates a block diagram of a wall switch box, in accordance with various embodiments.

Aspects of the subject disclosure will now be described more fully hereinafter with reference to the accompanying drawings in which example embodiments are shown. In the following description, for purposes of explanation, numerous specific details are set forth in order to provide a thorough understanding of the various embodiments. However, the subject disclosure may be embodied in many different forms and should not be construed as limited to the example embodiments set forth herein.

Government energy codes, e.g., the International Energy Conservation Code (IECC), etc. establish minimum building design requirements to save energy, e.g., specifying that motion sensors can be used to control lighting, e.g., shut lights off when no motion is detected in a room of a building, etc. Such sensors are distinct from other sensors of a security system installed in the building, e.g., used to detect unauthorized occupants of the building during non-business hours.

Various embodiments disclosed herein can eliminate the redundancy of mounting separate sensors in a building to meet security and energy efficiency needs by integrating a low voltage motion sensing alarm with a high voltage light source—within a form factor conforming to industry standard construction junction boxes. For example, such embodiments can be housed in a small enclosure designed to fit in a standard size wall junction box that would normally contain a manual toggle light switch or motion controlled light switch. Further, such embodiments enable easy installation in new construction, as well as retrofit in existing construction, to provide energy efficiency, convenience, and security controls in a single, cost effective, small form factor device.

For example, an apparatus can include a voltage conversion component that generates, within a wall switch box, e.g., a single-gang electrical box, a wall junction box, etc. a direct current (DC) voltage, e.g., 12 volts DC (VDC), from an alternating current (AC) voltage that is higher in magnitude than the DC voltage, e.g., 85 to 305 volts AC (VAC). Further, the apparatus can include a motion sensing component that detects, from the wall switch box using the DC voltage, a motion of an object, e.g., using a passive infrared (IR) based DC sensor and/or an ultrasonic based DC sensor installed in the wall switch box.

In an embodiment, the apparatus can include a power component that switches, from the wall switch box using the DC voltage based on the motion, the AC voltage from a first contact to a second contact, e.g., the second contact electrically coupled to a light fixture. In another embodiment, the power component can switch the AC voltage from the first contact to the second contact based on a detected contact of a switch, mechanical switch, touch sensor, etc. that is electrically connected, coupled, etc. to the DC voltage, e.g., to override, prevent, etc. power component from powering a light fixture when a motion has been detected by the motion sensing component.

In another embodiment, the apparatus can include a security component that generates, from the wall switch box using the DC voltage, an alarm signal based on the motion. In yet another embodiment, the apparatus can include an encoder component that encodes, using the DC voltage, the alarm signal based on a defined binary key. For example, the defined binary key can be digitally set, programmed, etc. for security purposes via a selectable setup feature of the encoder component, e.g., the defined binary key representing 1 of $2^{24}$ possible key words.

In one embodiment, the apparatus can further include a wireless transmitter component that wirelessly transmits, using the DC voltage, the alarm signal from the wall switch box, e.g., to an annunciation panel, control panel, alarm interface, etc. In this regard, the annunciation panel can be wirelessly coupled to wall switch boxes installed in a building, and used to determine where motion was detected within the building, e.g., by visually indicating which wall switch box transmitted the alarm signal.

In an embodiment, the apparatus can further include a microphone and/or video camera that generates, using the DC voltage, data based on the motion. Further, the transceiver component can wirelessly transmit, using the DC voltage, the data from the wall switch box to the annunciation panel, which can play, record, etc. sound and/or video corresponding to the detected motion using the data.

In another embodiment, the annunciation panel can call, dial, etc. a predetermined phone number, e.g., cell phone number, emergency contact number, 9-1-1, etc. in response to the alarm signal being received, e.g., to alert authorities of a trespass, etc.

In yet another embodiment, a wall switch plate can comprise a first switch that is electrically coupled to a DC voltage, e.g., 12 VDC, and activates, based on a detected contact of the first switch, a relay within a wall switch box—the relay switching an AC voltage, e.g., 85 to 305 VAC, from a first contact to a second contact to power a light fixture in response to detection of a motion of an object, wherein the DC voltage has been generated by the AC voltage within the wall switch box, and wherein a first magnitude of the AC voltage is greater than a second magnitude of the DC voltage. Further, the wall switch plate comprises an opening corresponding to a portion of a motion sensing component that detects, from the wall switch box using the DC voltage, the motion of the object.

In an embodiment, the wall switch plate can include a translucent portion corresponding to a light emitting diode (LED) that emits, using the DC voltage, light based on the motion. In another embodiment, the wall switch plate can include a second switch, e.g., mechanical switch, touch sensor, etc. that electrically couples, connects, etc. the DC voltage to the LED based on a detected contact of the second switch. In yet another embodiment, the wall switch box comprises a security component that wirelessly generates, using the DC voltage, an alarm signal based on the motion.

Another embodiment can include an apparatus, e.g., receiver, annunciation panel, etc. comprising a voltage conversion component that generates a DC voltage from an AC voltage that is higher in magnitude than the DC voltage. Further, the apparatus can include an alarm component that wirelessly receives, using the DC voltage, alarm signal(s) from motion sensing component(s) of wall switch box(es) of a building based on motion(s) detected by the motion sensing component(s). Furthermore, the alarm component can generate an alarm output in response to a determination that the alarm signal(s) satisfy a defined condition with respect to a binary key, e.g., digitally set, programmed, etc. for security purposes via a selectable setup feature of the decoder component, e.g., representing an annunciation panel keyword of 1 of $2^{24}$ possible key words matching wall switch box keyword(s) programmed via a pushbutton setup switch function of the encoder component of the wall switch box(es).

In one embodiment, the alarm component can activate an LED based on the alarm output. In another embodiment, the alarm component can generate the alarm output in response to a determination that an input representing a deactivation of the alarm has not been received, e.g., via a user interface (UI) of the apparatus.

In yet another embodiment, the apparatus can include a wireless transceiver component that wirelessly transmits, using the DC voltage, data based on the alarm output. In embodiment(s), the data comprises audio and/or video information wirelessly received by the alarm component, using the DC voltage, from motion sensing component(s) of the wall switch box(es).

Reference throughout this specification to "one embodiment," or "an embodiment," means that a particular feature, structure, or characteristic described in connection with the embodiment is included in at least one embodiment. Thus, the appearances of the phrase "in one embodiment," or "in an embodiment," in various places throughout this specification are not necessarily all referring to the same embodiment. Furthermore, the particular features, structures, or characteristics may be combined in any suitable manner in one or more embodiments.

Furthermore, to the extent that the terms "includes," "has," "contains," and other similar words are used in either the detailed description or the appended claims, such terms are intended to be inclusive—in a manner similar to the term "comprising" as an open transition word—without precluding any additional or other elements. Moreover, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

As utilized herein, the term "component" is intended to refer to a device, a circuit element, an electrical component, a group of devices, a group of circuit elements, and/or a group of electrical components. As another example, a component can be an apparatus with specific functionality provided by mechanical parts operated by electric or electronic circuitry; the electric or electronic circuitry can be operated by a software application or a firmware application executed by one or more processors; the one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components.

Furthermore, the word "exemplary" and/or "demonstrative" is used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art.

Referring now to FIG. 1, a block diagram 100 of wall switch box 102, e.g., a single-gang electrical box, a wall junction box, etc. is illustrated, in accordance with various embodiments. Wall switch box 102 can include voltage conversion component 110, motion sensing component 120, and power component 130. As illustrated, voltage conversion component 110 can receive AC power 105, e.g., via electrical wiring installed within, at, etc. wall switch box 102. In an embodiment, AC power 105 includes voltages from 85 to 305 VAC. Voltage conversion component can generate DC voltage 115, e.g., 12 VDC, within wall switch box 102 from AC power 105, e.g., an AC voltage that is higher in magnitude than the DC voltage.

Motion sensing component 120 can detect, from wall switch box 102 using DC voltage 115, a motion of an object, person, pet, etc., e.g., within a sensing range, area, etc. of wall switch box 102. In this regard, motion sensing component 120 can detect the motion of the object using sensor 122, e.g., an infrared based DC motion sensor and/or an ultrasonic based DC motion sensor that is installed in wall switch box 102, and generate motion signal 125 in response to the detected motion.

Power component 130 can receive AC power 105, and switch, from wall switch box 102 using DC voltage 115 based on motion signal 125, AC power 105 from a first contact to a second contact, e.g., electrically coupled to AC load 135, e.g., a light fixture. In another embodiment, power component 130 can switch AC power 105 from the first contact to the second contact based on a detected contact of switch 132, e.g., a mechanical switch, touch sensor, etc. that is electrically connected, coupled, etc. to DC voltage 115, e.g., to override, prevent, etc. powering of the light fixture when a motion has been detected by motion sensing component 120. Further, light emitting diode (LED) 134, can emit light, using the DC voltage, based on motion signal 125.

Figure 2:
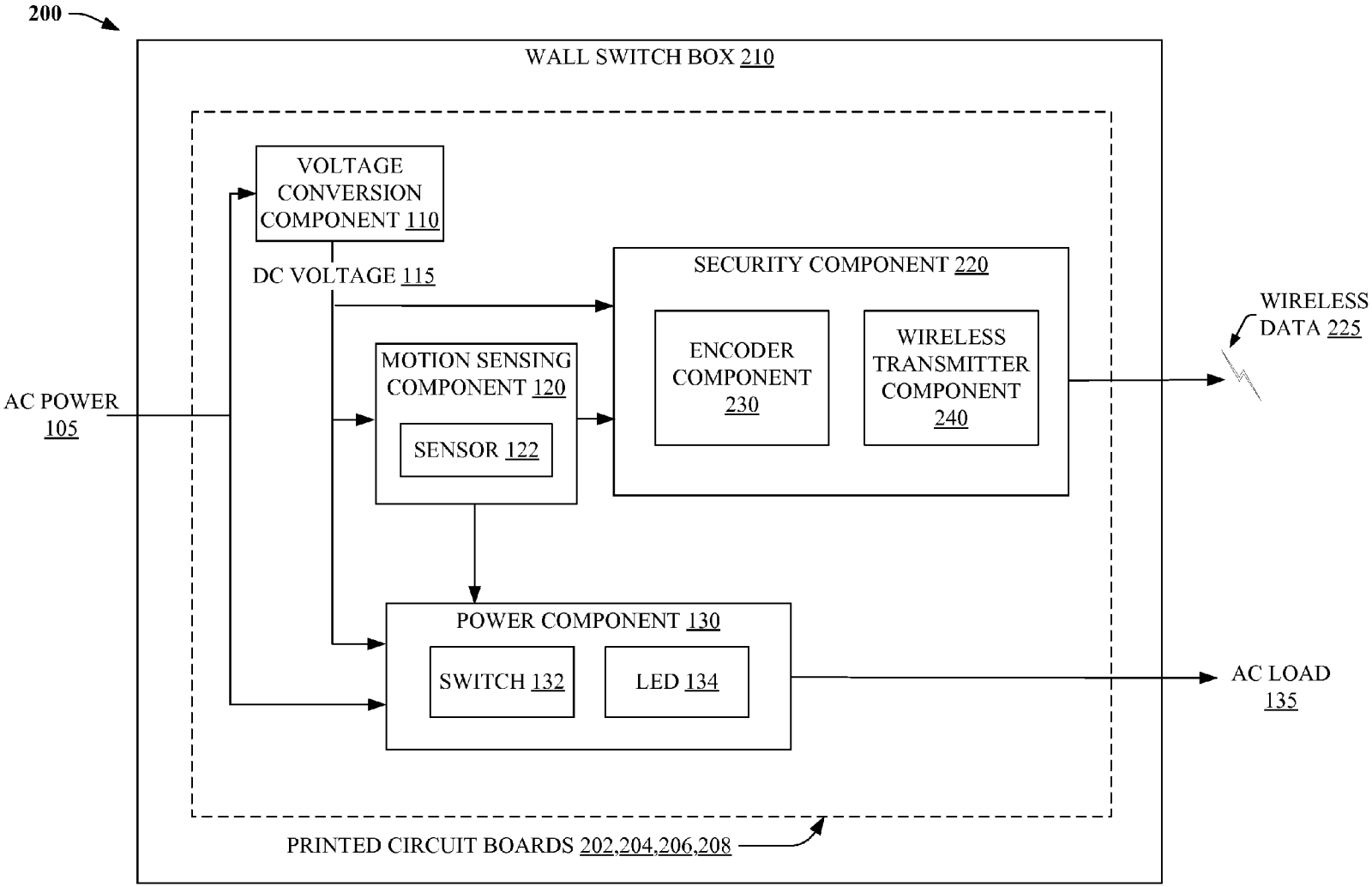
FIG. 2 illustrates another block diagram of a wall switch box, in accordance with various embodiments.

In an embodiment illustrated by FIG. 2, wall switch box 210 can further include security component 220 that generates, from wall switch box 210 using DC voltage 115, an alarm signal (not shown) based on motion signal 125. In another embodiment, security component 220 can include encoder component 230 that encodes, using DC voltage 115, the alarm signal based on a defined binary key. For example, the defined binary key can be manually set, programmed, etc. for security purposes via a pushbutton setup switch (not shown), e.g., representing 1 of $2^{24}$ possible key words. Security component 220 can further include wireless transmitter component 240 that can wirelessly transmit, using DC voltage 115 based on the alarm signal, wireless data 125 from wall switch box 210, e.g., directed to an annunciation panel, control panel, alarm interface (see e.g. alarm component 820 below), etc.

Figure 3:
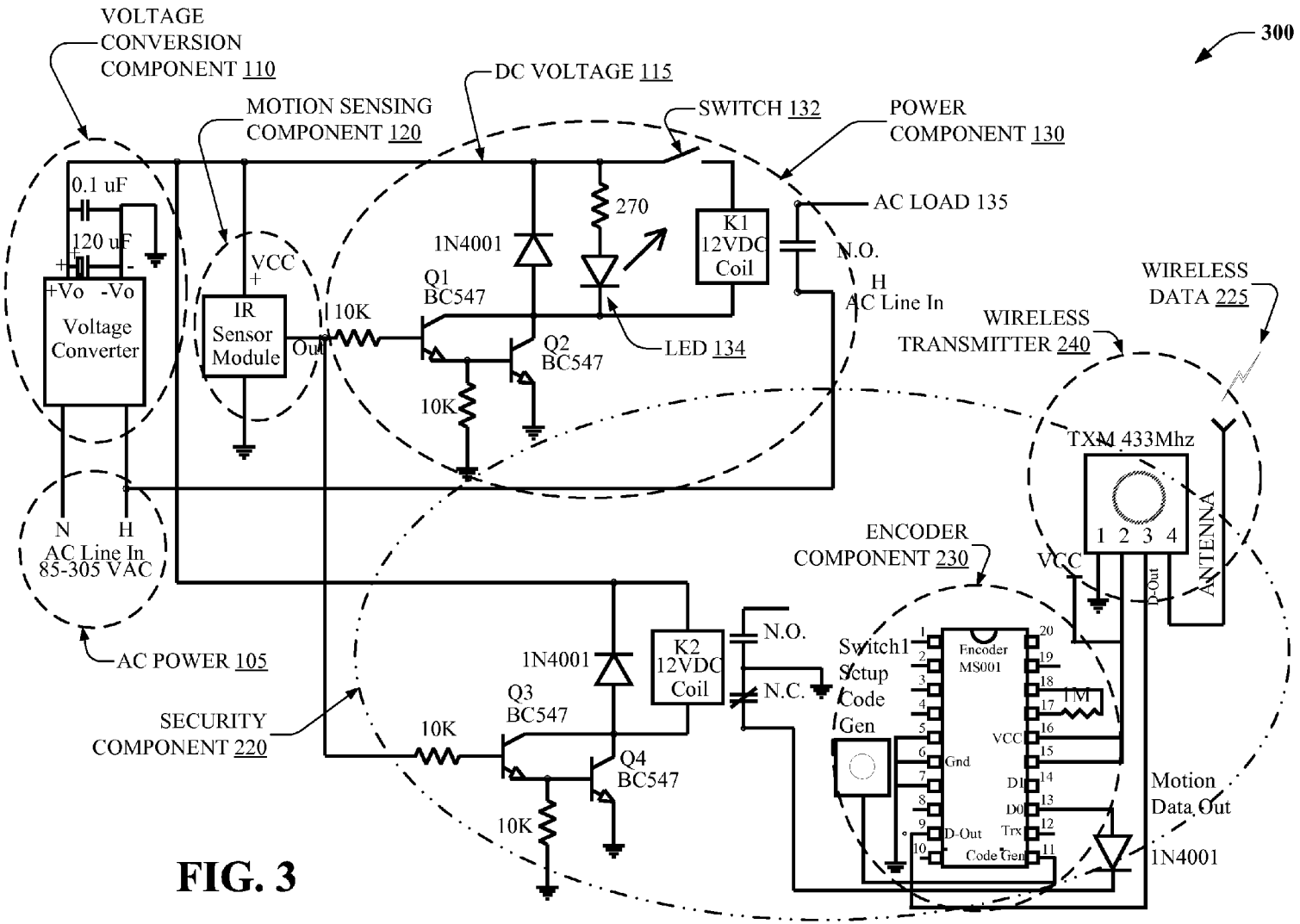
FIG. 3 illustrates an electronic schematic of a wall switch box, in accordance with various embodiments.

In the electronic schematic 300 of wall switch box 210 illustrated by FIG. 3, voltage conversion component 110 includes an auto-switching voltage converter that automatically senses and converts voltages of AC Power 105—within a range of 85 to 305 VAC—to 12 VDC. In one or more embodiments, the auto-switching voltage converter meets one or more of the following specifications: 30 milliwatts (mW) max of no-load power consumption; high power conversion efficiency, e.g., up to 80%; isolated 3 kilo VAC output protection for 1 minute; short circuit protection; overvoltage protection; EN55022 and FCC Class B specifications built-in fusible resistor. In this regard, voltage conversion component 110 can generate DC voltage 115 while sourcing only a very small portion of power from AC power 105, e.g., maintaining a larger portion of power from AC power 105 to be switched, as described below, to lighting fixtures or other high-voltage powered devices.

Motion sensing component 120 includes a sensor module, e.g., sensor 122, which can include a passive IR based DC motion sensor, an ultrasonic based DC motion sensor, etc. An output of the sensor module, e.g., motion signal 125, goes high, e.g., 12 VDC, when sensor 122 detects a motion. In one or more embodiments, sensor 122 can be adjusted for range detection, e.g., from 3 meters to 7 meters, and a duration of time that the output of the sensor module remains activated by the detected motion can be adjusted, e.g., from 5 seconds to 5 minutes.

In response to the output of the sensor module going high, Darlington transistor pair Q1/Q2 of power component 130 and Darlington transistor pair Q3/Q4 of security component 220 are activated. In this regard, amplified current of Darlington transistor pair Q1/Q2 activates LED 134 and a 12 VDC coil of lighting relay K1, which attaches AC Load 135, e.g., electronically connected to a light fixture, to an AC input feed voltage, e.g., AC Power 105. However, switch 132, e.g., a light override switch, can disable activation of lighting relay K1—enabling the light fixture to be manually switched off without affecting alarm functions corresponding to security component 220.

Regardless of the position of switch 132, amplified current of Darlington transistor pair Q3/Q4 activates a 12 VDC coil of isolation relay K2, which attaches to an input of encoder component 230, e.g., a data pin "D0" of an MS001 encoder chip, e.g., manufactured by Linx Technologies™. In this regard, the input of the data pin goes high, activating generation and wireless encoding of an alarm signal, data, etc. that is output from "D-OUT" of the MS001 encoder chip.

The MS001 encoder chip is addressable with $2^{24}$ combinations via "Switch 1", a code generator mode pushbutton setup switch attached to the MS001 encoder chip. The addressing feature allows uniquely identified wireless radio frequency (RF) signals to be configured for multiple zones, and for avoidance of conflicts with signals from other sources in nearby locations on a common carrier frequency. In this regard, the output of the MS001 encoder chip is broadcast via wireless transmitter 240, e.g., a 433 megahertz (MHz) transmitter module, as wireless data 225. In an embodiment, the 433 MHz transmitter is rated up to 900 meters of transmission distance depending on physical and RF signal interference.

Figure 4:
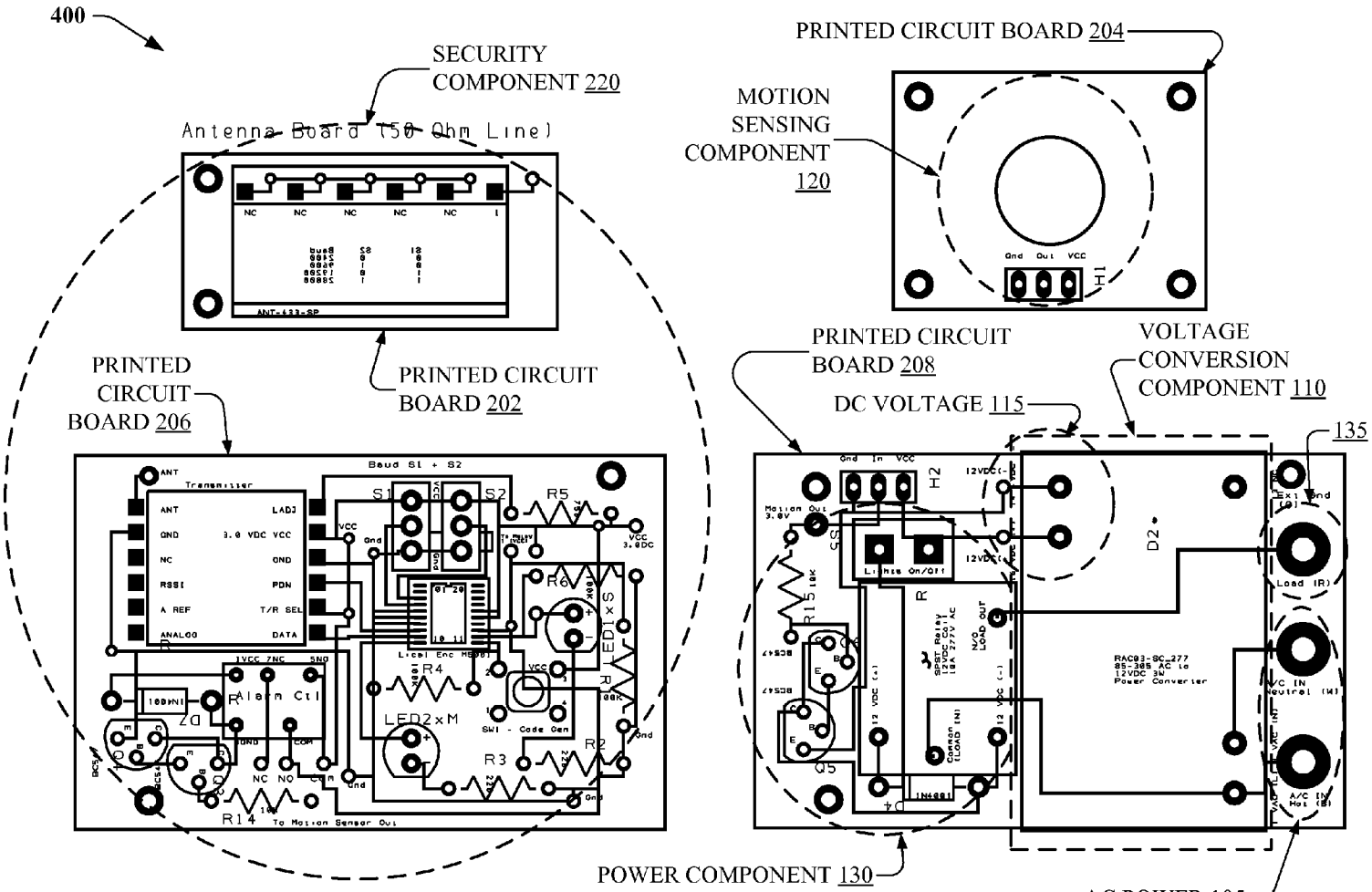
FIG. 4 illustrates printed circuit boards placed within a wall switch box, in accordance with various embodiments.

As illustrated by FIG. 4, components, circuit elements, devices, etc. of wall switch box 210, e.g., of electronic schematic 300, are included in multi-layer printed circuit board (PCB) configuration including PCB 202, PCB 204, PCB 206, and PCB 208, which separates device electronics into power and functional categories, and fits within industry standard construction wall junction boxes while isolating high-voltage AC circuits and switching components from low-voltage DC electronics.

PCB 202, e.g., an antenna board, includes a compact, surface mount antenna array that provides long distance transmission without further external antenna requirements, and can be positioned within wall switch box 210 to further isolate sensitive antenna array components from power sources and other components generating electronic noise. Further, PCB 202 can be moved forward in the wall junction box to optimize wireless signal transmission via the surface mount antenna array.

PCB 204, which includes sensor components, e.g., sensor 122, can be placed forward of the other PCBs for sensing movement from a face of wall switch box 210, e.g., from a facing of casing 502 described below.

PCB 206 includes low-voltage components for alarm system encoding, wireless transmission, and configuration. Components and individual component pins on PCB 206 operate at low voltages ranging from 0.3 VDC to 4.25 VDC, and are isolated from the other PCBs to reduce signal interference from higher voltage circuitry.

PCB 208 includes a high-voltage, e.g., 85 to 305 VAC interface power input, power conversion components, and switching relay controls electrically coupled to the sensor and low-voltage components.

Figure 5:
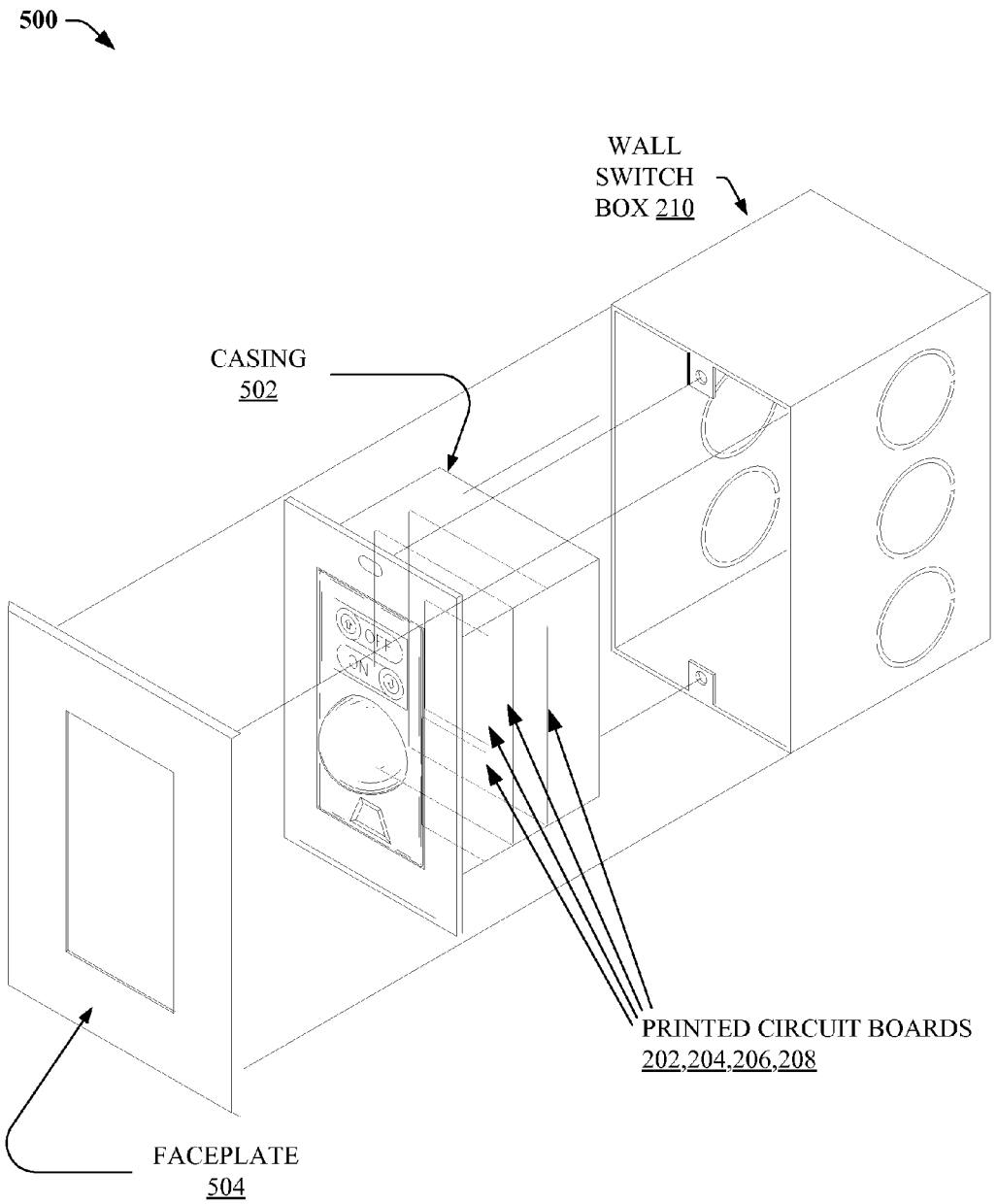
FIG. 5 illustrates yet another block diagram of a wall switch box, in accordance with various embodiments.

As described above, and in embodiments illustrated by FIGS. 5 and 6, PCB 202, PCB 204, PCB 206, and PCB 208 can be positioned, placed, etc. within casing 502 to fit within wall switch box 210. In this regard, faceplate 504 can be a standard electrical cover plate placed over casing 502 to trim out wall switch box 210. In other embodiments, faceplate 504 can be a decorative face and/or cover plate of multiple colors and shapes that can be used to trim out wall switch box 210.

Figure 6:
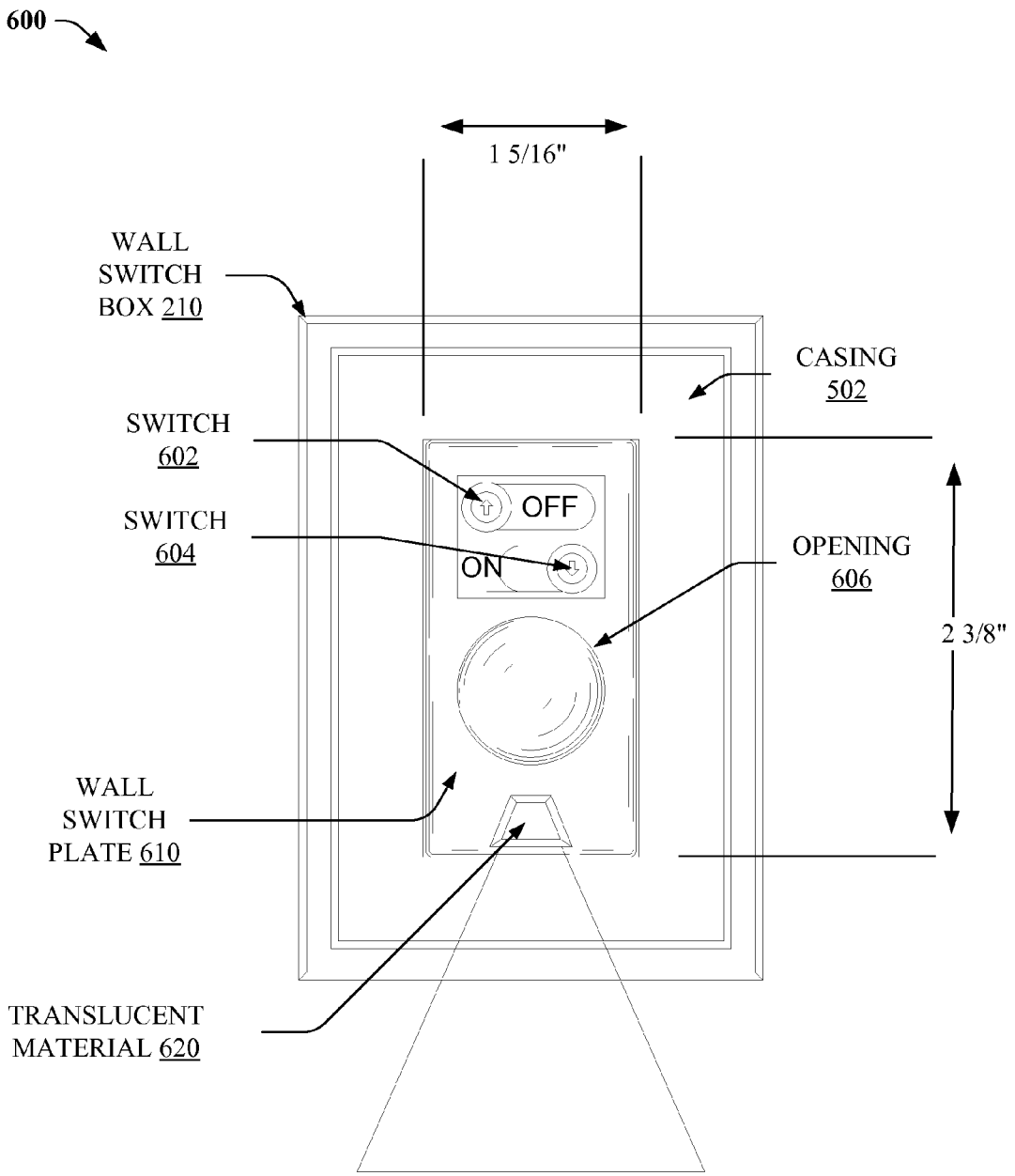
FIG. 6 illustrates a face design of a casing of a wall switch box, in accordance with various embodiments.

Now referring to FIG. 6, a wall switch plate 610 of casing 502 of wall switch box 210 is illustrated, in accordance with various embodiments. Switch 602, e.g., switch 132, a touch based switch, mechanical sliding switch, mechanical toggle switch, etc. is electrically coupled between 12 VDC and lighting relay K1 of power component 130. In this regard, switch 602 operates as a light override switch that can disable activation of lighting relay K1, thereby removing power from a light fixture (not shown) that is connected to power component 130—without affecting alarm functions corresponding to security component 220.

Switch 604, e.g., a touch based switch, mechanical sliding switch, mechanical toggle switch, etc. electrically couples 12 VDC of power component 130 to a night light, LED, etc. (not shown), that can be powered on/off regardless of motion detected by motion sensing component 120. In one embodiment, wall switch plate 610 can include translucent material 620 covering one or more portions of the night light, etc. Opening 606 corresponds to a portion of sensor 122 of motion sensing component 120, e.g., a passive IR based DC motion sensor, an ultrasonic based DC motion sensor, etc. that senses the motion of objects external to wall switch plate 610.

Figure 7:
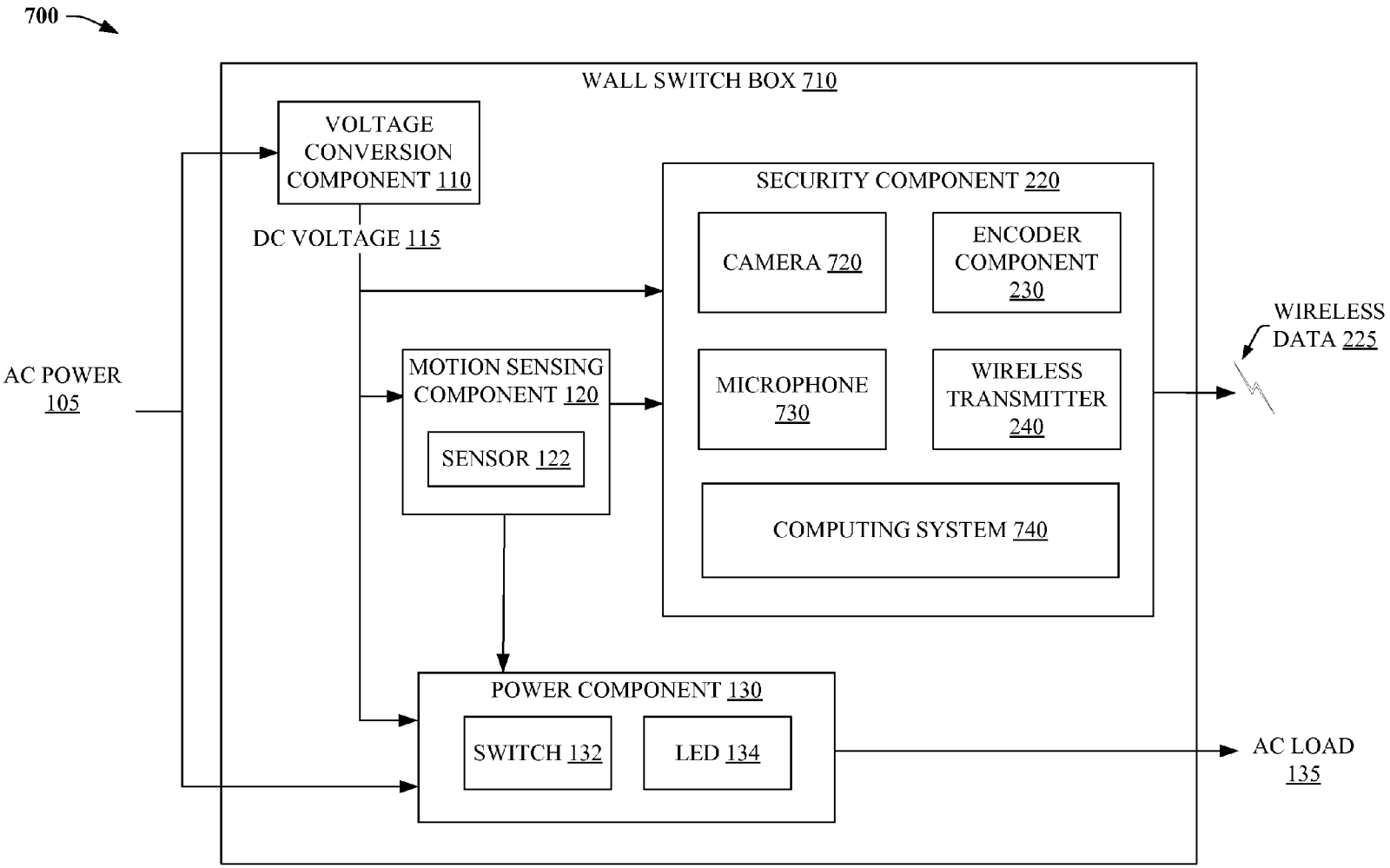
FIG. 7 illustrates a block diagram of a wall switch box including a camera and a microphone, in accordance with various embodiments.

FIG. 7 illustrates a block diagram of wall switch box 710 including camera 720 and microphone 730, in accordance with various embodiments. Camera 720, e.g., an embedded, DC based video camera, standard wavelength video camera, IR video camera, etc. and microphone 730, e.g., an embedded DC based microphone, etc. can be communicatively coupled to, and configured by, computing system 740, e.g., an embedded microcontroller/microprocessor based system, etc. to capture, record, etc. sound, video, images, etc. from wall switch box 710, for example, in response to detection of a motion by motion sensing component 120. In this regard, computing system 740 can be configured to wirelessly transmit, via wireless transmitter 240, wireless data 225 including audio and/or video information, for example, to an annunciation panel, control panel, alarm interface, etc. Further, the annunciation panel can be configured to play, record, etc. sound and/or video corresponding to the detected motion using the data, e.g., for remote monitoring of the location of wall switch box 710.

Figure 8:
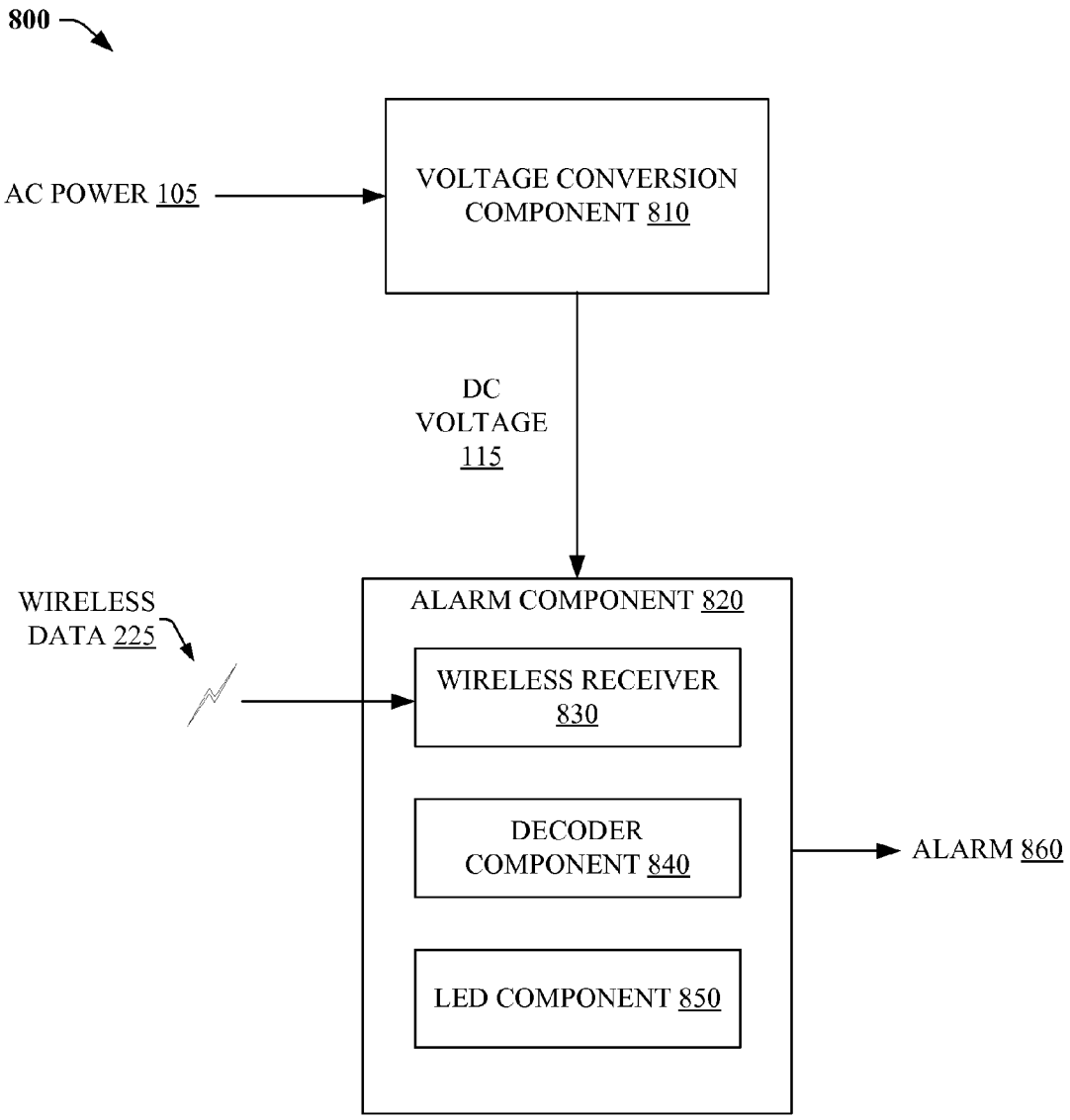
FIG. 8 illustrates a block diagram of an alarm system, in accordance with various embodiments.

Referring now to FIG. 8, a block diagram of alarm system 800, e.g., installed in an annunciation panel, is illustrated, in accordance with various embodiments. Alarm system 800 can include voltage conversion component 810 and alarm component 820. Voltage conversion component 810 can receive AC power 105 that can include voltages from 85 to 305 VAC, e.g., via electrical wiring installed in a wall of a building. Further, voltage conversion component 810 can generate DC voltage 115, e.g., 12 VDC, from AC power 105, e.g., an AC voltage that is higher in magnitude than the DC voltage.

Alarm component 820 can wirelessly receive, via wireless receiver 830 using DC voltage 115, an alarm signal, e.g., wireless data 225, from motion sensing component 120, e.g., from wall switch box 102, 210, 710, etc. within a sensing range, area, etc. of alarm component 820, based on a motion detected by motion sensing component 120 of wall switch box 102, 210, 710, etc. Further, alarm component 820 can output, generate, etc. alarm 860 in response to decoder component 840 determining that the alarm signal satisfies a defined condition with respect to a binary key. For example, the defined binary key can be manually set, programmed, etc. for security purposes via a pushbutton setup switch, e.g., representing 1 of $2^{24}$ possible key words, e.g., representing a keyword of the annunciation panel matching a wall switch box keyword that has been programmed via pushbutton setup switch(es) of wall switch box(es) wirelessly coupled to alarm component 820.

In one embodiment, alarm component 820 can activate an LED (not shown) of LED component 850 when alarm 860 is output by alarm component 820. In another embodiment, alarm component 820 can activate another LED (not shown) of LED component 850 when decoder 840 determines that the alarm signal satisfies the defined condition with respect to the binary key, e.g., that the keyword of the annunciation panel matches a wall switch box keyword wirelessly coupled to alarm component 820, that the alarm signal received by wireless receiver 830 is a valid carrier signal, etc.

Figure 9:
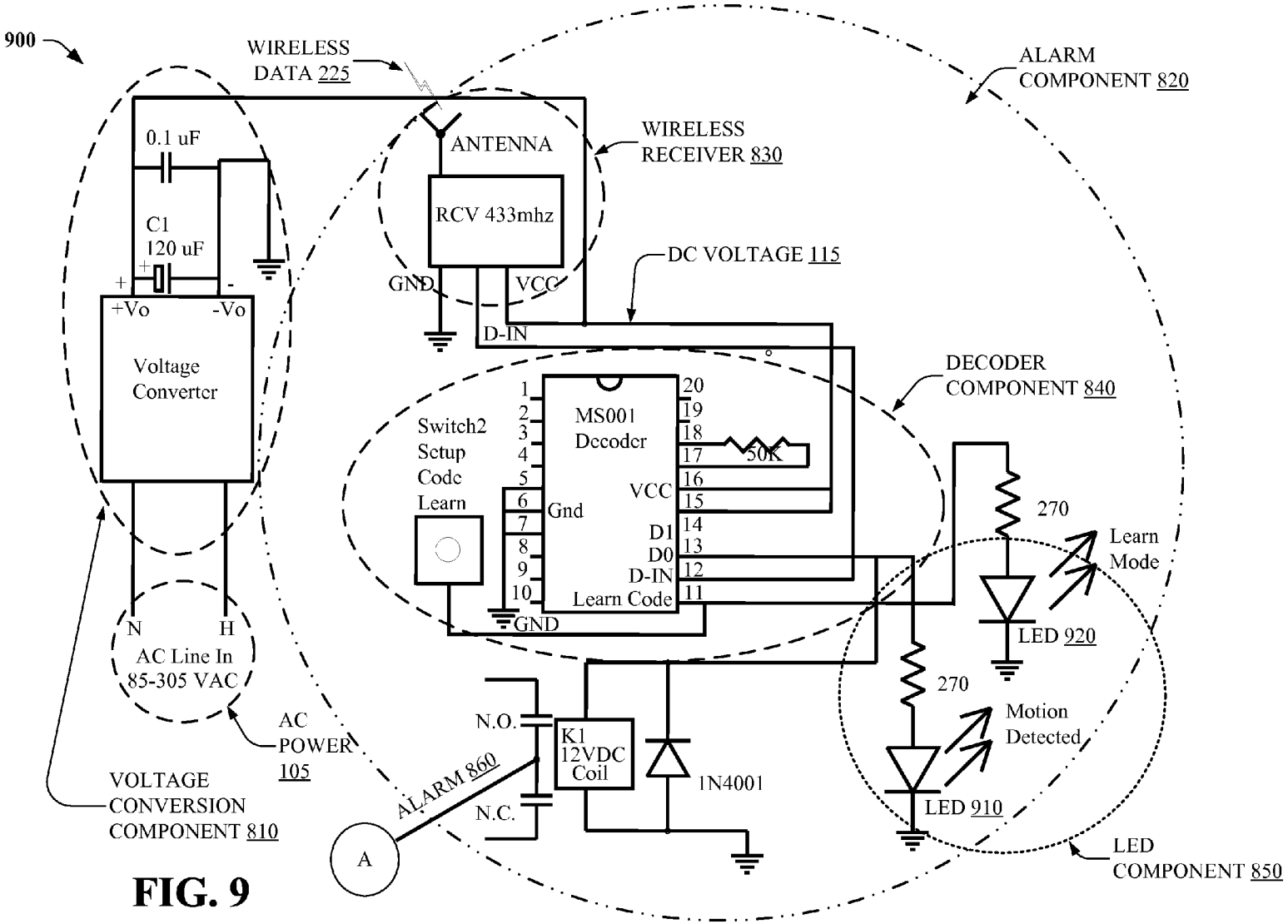
FIG. 9 illustrates an electrical schematic of an alarm system, in accordance with various embodiments.

FIG. 9 illustrates an electrical schematic 900 of alarm system 800, in accordance with various embodiments. Voltage conversion component 810 includes an auto-switching voltage converter that automatically senses and converts voltages of AC Power 105, within a range of 85 to 305 VAC, to 12 VDC. In one or more embodiments, the auto-switching voltage converter meets one or more of the following specifications: 30 milliwatts (mW) max of no-load power consumption; high power conversion efficiency, e.g., up to 80%; isolated 3 kVAC output protection for 1 minute; short circuit protection; overvoltage protection; EN55022 and FCC Class B specifications; built-in fusible resistor. In this regard, voltage conversion component 110 can generate DC voltage 115 while sourcing only a very small portion of power from AC power 105.

Wireless receiver 830 of alarm component 820 includes a wireless receiver, e.g., a 433 MHz receiver module, which receives wireless data 225. In an embodiment, the 433 MHz receiver is rated to receive wireless data 225 transmitted from distance(s) up to 900 meters from alarm system 800, depending on physical and RF signal interference. An MS001 decoder chip, e.g., manufactured by Linx Technologies™, can receive, at data input "D-IN", data from the 433 MHz receiver module corresponding to wireless data 225, and decode the data based on a binary combination, or key, of $2^{24}$ possible combinations set via pushbutton setup switch "Switch 2" that is attached to input pin 11 of the MS001 decoder chip. In this regard, the MS001 decoder chip activates, e.g., sets high, data output "D0" in response to the stored security keyword setting matching a security keyword setting of a remote wall switch box that transmitted wireless data 225 to alarm system 800. Such addressing feature allows uniquely identified wireless RF signals to be configured for multiple zones, and for avoidance of conflicts with signals from other sources in nearby locations on a common carrier frequency. In one embodiment, the data received at data input "D-IN" can be verified, e.g., by computing system 1140 described below, three or more times to avoid false signal generation.

When data output "D0" is set high, or activated, LED 910 is illuminated to indicate that a motion had been detected at a remote wall switch box. In one embodiment, LED 920 is illuminated to indicate that a keyword learn mode has been activated on the MS001 decoder chip, e.g., that the decoder component 840 is set to learn, e.g., store, etc. the security keyword setting of security component 220 of the remote wall switch box that transmitted wireless data 225. Further, when data output "D0" is set high, 12 VDC coil of relay K1 is activated, invoking either a "normally closed" or "normally open" type circuit activation of output signal alarm 860.

Figure 10:
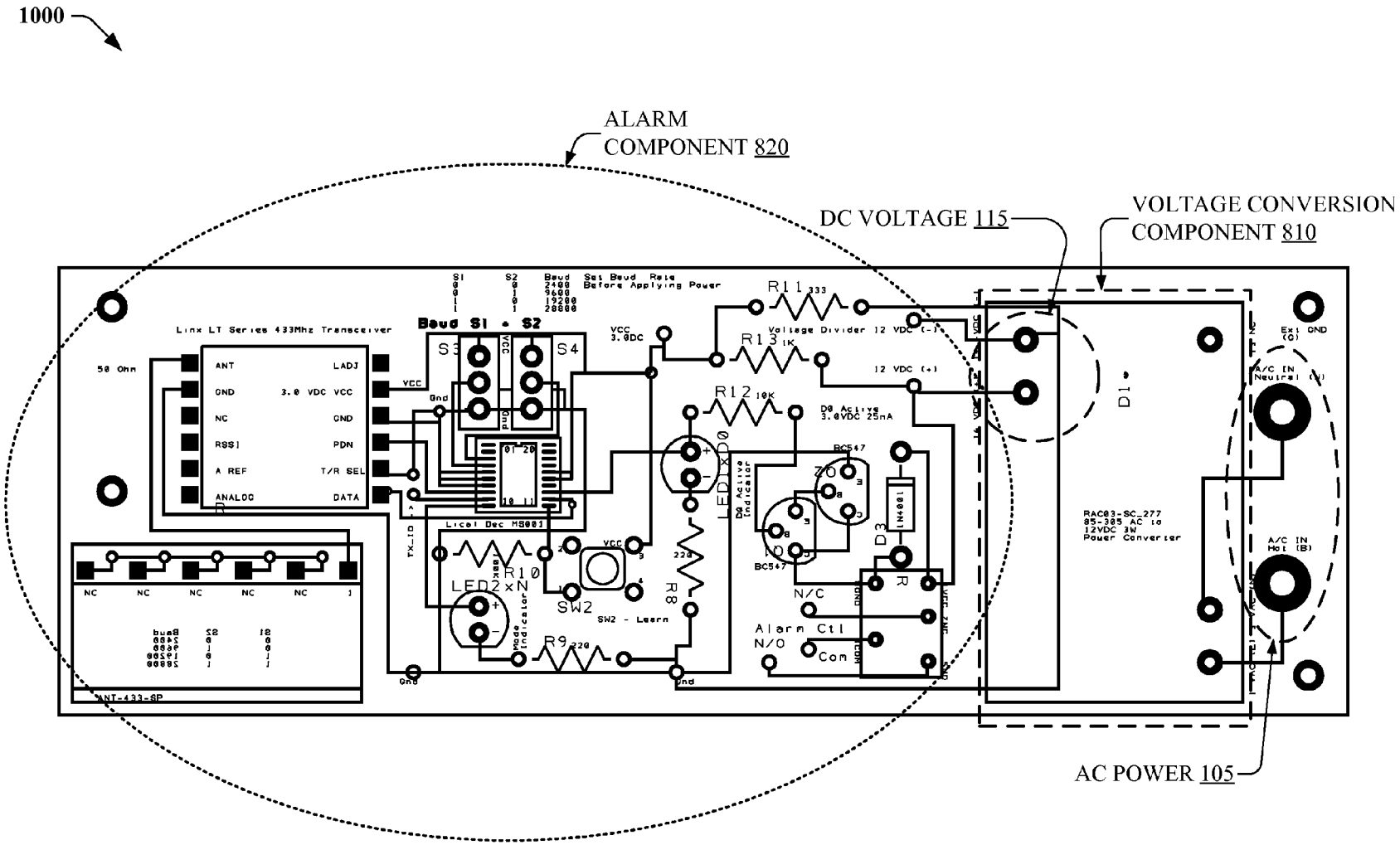
FIG. 10 illustrates a printed circuit board of an alarm system, in accordance with various embodiments.

As illustrated by FIG. 10, components, circuit elements, devices, etc. of alarm system 800, e.g., of electronic schematic 900, are included in PCB 1000. In this regard, high-voltage AC circuitry, e.g., AC Power 105 and voltage conversion component 810, and switching component(s), e.g., corresponding to output signal alarm 860, are separated from low-voltage DC electronics, e.g., corresponding to decoder component 840, within a single PCB.

Figure 11:
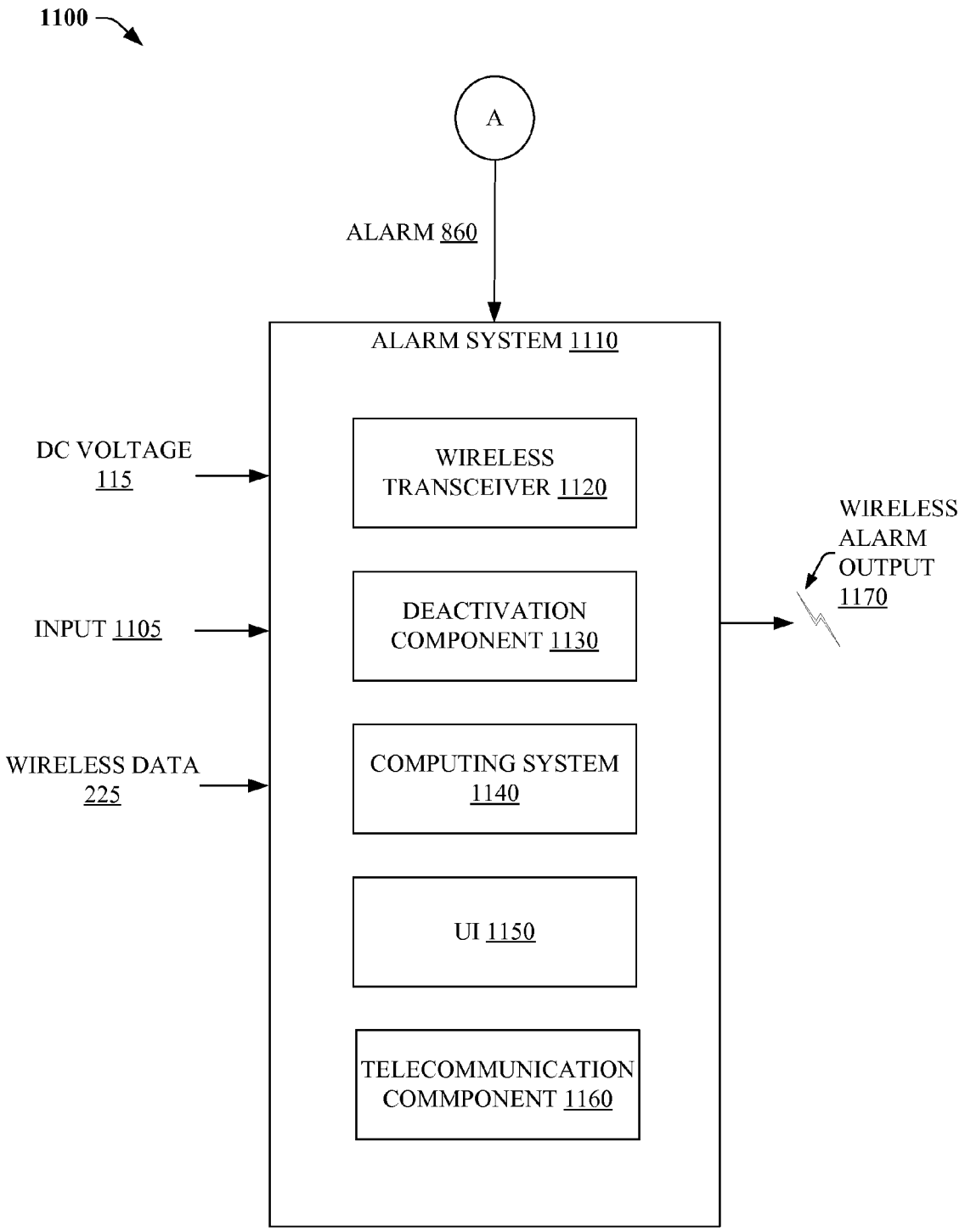
FIG. 11 illustrates a block diagram of another alarm system, in accordance with various embodiments.
Figure 12:
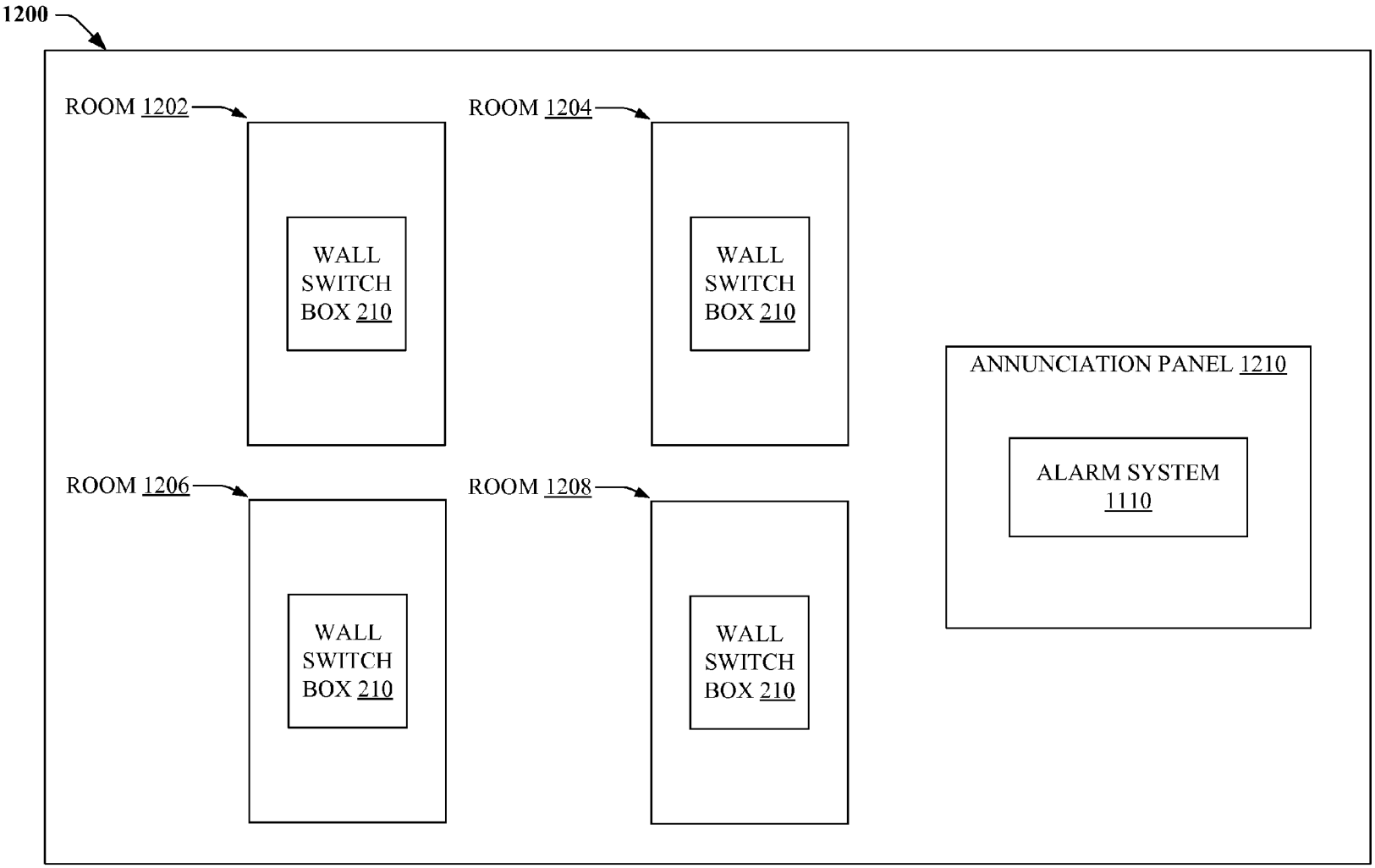
FIG. 12 illustrates a block diagram of a building including an alarm system, in accordance with various embodiments.

FIG. 11 illustrates a block diagram of another alarm system (1100), in accordance with various embodiments. Components, devices, etc. of alarm system 1100, e.g., an annunciation panel, are powered by DC voltage 115, e.g., generated by voltage conversion component 810. Computing system 1140, e.g., an embedded microcontroller/microprocessor based system, etc. can be configured to receive input 1105, e.g., via UI 1150, e.g., a keyboard, keypad, voice activated system, etc. from an operator, homeowner, business owner, etc. of alarm system 1100 for controlling operation of alarm system 1100. Further, UI 1150 can include one or more displays, monitors, speakers, etc. that display video, emit audio, etc. information corresponding to detected motion data received, e.g., received from wall switch boxes 210 of building 1200 illustrated by FIG. 12. In this regard, alarm system 1100 can be included in annunciation panel 1210, e.g., an alarm panel, etc. of building 1200, which can be wirelessly coupled, via wireless receiver 830, to wall switch boxes 210 located in rooms 1202, 1204, 1206, and 1208, respectively, to receive wireless data 225.

In another embodiment, computing system 1140 can be configured to receive input 1105, and transmit wireless alarm output 1170 in response to a determination that a motion had been detected at a remote wall switch, e.g., based on alarm 860, using wireless transceiver 1120. For example, computing system 1140 can receive input 1105 and transmit wireless alarm output 1170 using cellular, WiFi, and/or Bluetooth® based technologies via authenticated Internet, web, smart phone, etc. based applications. In this regard, the operator, homeowner, business owner, etc. can remotely control lighting of building 1200, and remotely monitor motion alarm(s), video, audio, etc. of alarm system 1100. In one embodiment, alarm output 1170 can include audio and/or video information that was received in wireless data 225.

In another embodiment, the operator, homeowner, business owner, etc. can remotely control, via wireless transceiver 1120, lighting of building 1200 by deactivating, via deactivation component 1130, wireless alarm output 1170, e.g., if the operator deems the motion to be caused by a pet, a known occupant of building 1200, etc.

In another embodiment, the annunciation panel can utilize telecommunications component 1160 to call, dial, etc. a predetermined phone number, e.g., cell phone number, emergency contact number, 9-1-1, etc. in response to activation of alarm 860, e.g., to alert authorities of a trespass. In one embodiment, telecommunications component 1160 can include a telecom interface coupled to a wired telecommunication line, cable, etc. to call, dial, etc. the predetermined phone number. In another embodiment, telecommunications component 1160 an include a cellular interface to call, dial, etc. the predetermined phone number.

It should be appreciated that embodiments of devices, circuits, components, etc. described herein can be grounded via electrical ground wires and/or fully enclosed in plastic enclosures to provide circuit protection and isolation. Further, such embodiments can include backup battery components that power motion sensing components and functions during power failures. Furthermore, in other embodiments, conventional light fixture dimming controls, functionality, etc. can be included in the devices, circuits, components, etc. described herein to provide for dimmable lighting.

As it employed in the subject specification, the terms "processor", "embedded processor", "microcontroller", "embedded microcontroller", "microprocessor", "embedded microprocessor" and the like can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions and/or processes described herein. Processors can exploit nanoscale architectures such as, but not limited to, molecular and quantum-dot based transistors, switches and gates, in order to optimize space usage or enhance performance of mobile devices. A processor may also be implemented as a combination of computing processing units. Further, it will be appreciated that the memory components described herein can be either volatile memory or nonvolatile memory, or can include both volatile and nonvolatile memory.

Figure 13:
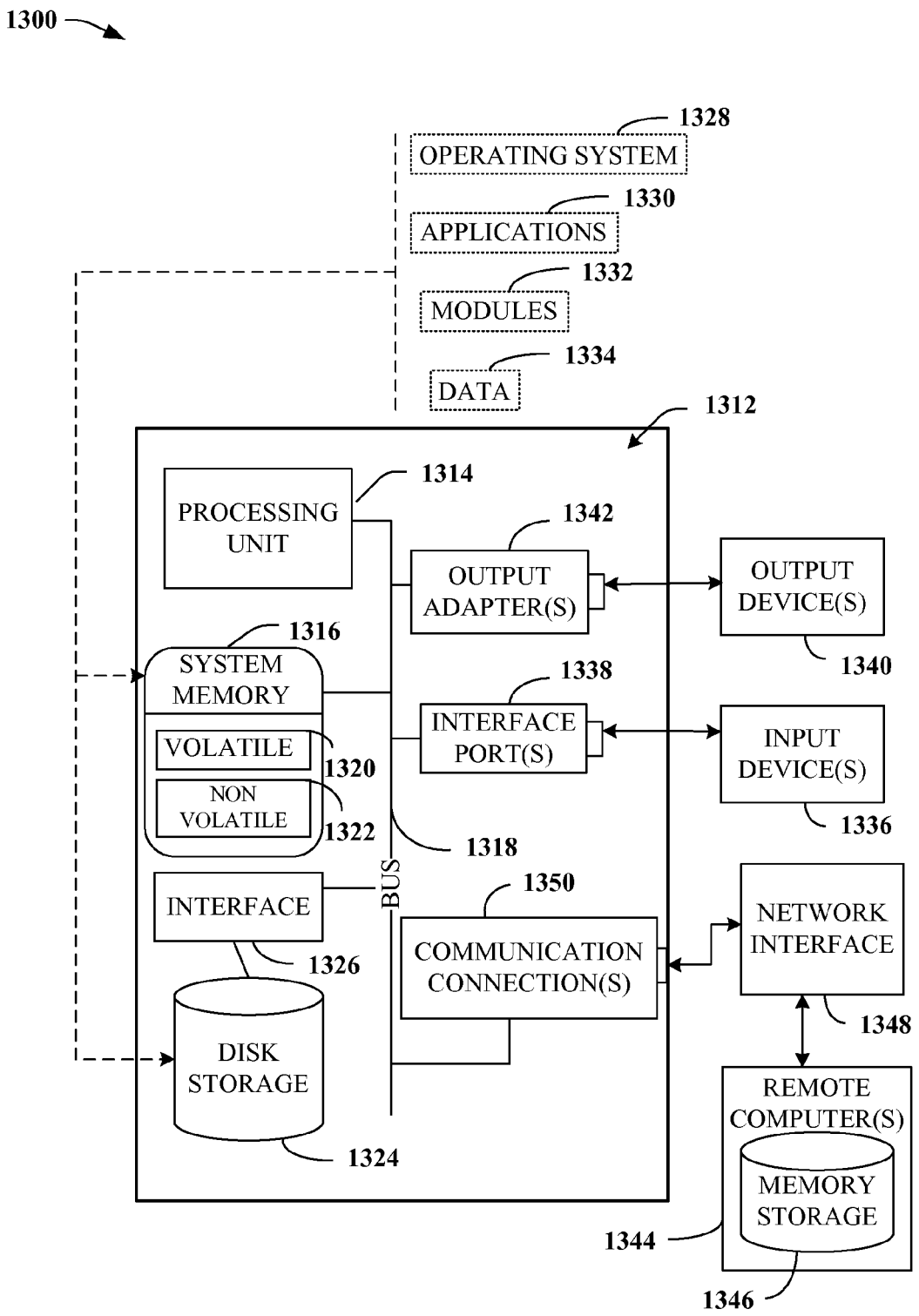
FIG. 13 illustrates a block diagram of a computing system, in accordance with various embodiments.

In order to provide a context for the various aspects of the disclosed subject matter, FIG. 13, and the following discussion, are intended to provide a brief, general description of a suitable environment in which the various aspects of the disclosed subject matter can be implemented. While the subject matter has been described above in the general context of computer-executable instructions of a computer program that runs on a computer and/or computers, those skilled in the art will recognize that the subject innovation also can be implemented in combination with other program modules. Generally, program modules include routines, programs, components, data structures, etc. that perform particular tasks and/or implement particular abstract data types.

Moreover, those skilled in the art will appreciate that the inventive systems can be practiced with other computer system configurations, including single-processor or multiprocessor computer systems, mini-computing devices, mainframe computers, as well as personal computers, handheld computing devices (e.g., PDA, phone, watch), microprocessor-based or programmable consumer or industrial electronics, and the like. The illustrated aspects can also be practiced in distributed computing environments where tasks are performed by remote processing devices that are linked through a communications network; however, some if not all aspects of the subject disclosure can be practiced on stand-alone computers. In a distributed computing environment, program modules can be located in both local and remote memory storage devices.

With reference to FIG. 13, a block diagram of a computing system 1300 operable to execute the disclosed systems, e.g., alarm system 1110, computing system 1140, etc. is illustrated, in accordance with an embodiment. Computer 1312 includes a processing unit 1314, a system memory 1316, and a system bus 1318. System bus 1318 couples system components including, but not limited to, system memory 1316 to processing unit 1314. Processing unit 1314 can be any of various available processors. Dual microprocessors and other multiprocessor architectures also can be employed as processing unit 1314.

System bus 1318 can be any of several types of bus structure(s) including a memory bus or a memory controller, a peripheral bus or an external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1394), Small Computer Systems Interface (SCSI), and/or controller area network (CAN) bus used in vehicles.

System memory 1316 includes volatile memory 1320 and nonvolatile memory 1322. A basic input/output system (BIOS), containing routines to transfer information between elements within computer 1312, such as during start-up, can be stored in nonvolatile memory 1322. By way of illustration, and not limitation, nonvolatile memory 1322 can include ROM, PROM, EPROM, EEPROM, or flash memory. Volatile memory 1320 includes RAM, which acts as external cache memory. By way of illustration and not limitation, RAM is available in many forms such as SRAM, dynamic RAM (DRAM), synchronous DRAM (SDRAM), double data rate SDRAM (DDR SDRAM), enhanced SDRAM (ESDRAM), Synchlink DRAM (SLDRAM), Rambus direct RAM (RDRAM), direct Rambus dynamic RAM (DRDRAM), and Rambus dynamic RAM (RDRAM).

Computer 1312 also includes removable/non-removable, volatile/non-volatile computer storage media. FIG. 13 illustrates, for example, disk storage 1324. Disk storage 1324 includes, but is not limited to, devices like a magnetic disk drive, floppy disk drive, tape drive, Jaz drive, Zip drive, LS-100 drive, flash memory card, or memory stick. In addition, disk storage 1324 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 1324 to system bus 1318, a removable or non-removable interface is typically used, such as interface 1326.

It is to be appreciated that FIG. 13 describes software that acts as an intermediary between users and computer resources described in suitable operating environment 1300. Such software includes an operating system 1328. Operating system 1328, which can be stored on disk storage 1324, acts to control and allocate resources of computer system 1312. System applications 1330 take advantage of the management of resources by operating system 1328 through program modules 1332 and program data 1334 stored either in system memory 1316 or on disk storage 1324. It is to be appreciated that the disclosed subject matter can be implemented with various operating systems or combinations of operating systems.

A user can enter commands or information into computer 1312 through input device(s) 1336. Input devices 1336 include, but are not limited to, a pointing device such as a mouse, trackball, stylus, touch pad, keyboard, microphone, joystick, game pad, satellite dish, scanner, TV tuner card, digital camera, digital video camera, web camera, cellular phone, user equipment, smartphone, and the like. These and other input devices connect to processing unit 1314 through system bus 1318 via interface port(s) 1338. Interface port(s) 1338 include, for example, a serial port, a parallel port, a game port, a universal serial bus (USB), a wireless based port, e.g., WiFi, Bluetooth®, etc. Output device(s) 1340 use some of the same type of ports as input device(s) 1336.

Thus, for example, a USB port can be used to provide input to computer 1312 and to output information from computer 1312 to an output device 1340. Output adapter 1342 is provided to illustrate that there are some output devices 1340, like display devices, light projection devices, monitors, speakers, and printers, among other output devices 1340, which use special adapters. Output adapters 1342 include, by way of illustration and not limitation, video and sound devices, cards, etc. that provide means of connection between output device 1340 and system bus 1318. It should be noted that other devices and/or systems of devices provide both input and output capabilities such as remote computer(s) 1344.

Computer 1312 can operate in a networked environment using logical connections to one or more remote computers, such as remote computer(s) 1344. Remote computer(s) 1344 can be a personal computer, a server, a router, a network PC, a workstation, a microprocessor based appliance, a peer device, or other common network node and the like, and typically includes many or all of the elements described relative to computer 1312.

For purposes of brevity, only a memory storage device 1346 is illustrated with remote computer(s) 1344. Remote computer(s) 1344 is logically connected to computer 1312 through a network interface 1348 and then physically and/or wirelessly connected via communication connection 1350. Network interface 1348 encompasses wire and/or wireless communication networks such as local-area networks (LAN) and wide-area networks (WAN). LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 1350 refer(s) to hardware/software employed to connect network interface 1348 to bus 1318. While communication connection 1350 is shown for illustrative clarity inside computer 1312, it can also be external to computer 1312. The hardware/software for connection to network interface 1348 can include, for example, internal and external technologies such as modems, including regular telephone grade modems, cable modems and DSL modems, wireless modems, ISDN adapters, and Ethernet cards.

The computer 1312 can operate in a networked environment using logical connections via wired and/or wireless communications to one or more remote computers, cellular based devices, user equipment, smartphones, or other computing devices, such as workstations, server computers, routers, personal computers, portable computers, microprocessor-based entertainment appliances, peer devices or other common network nodes, etc. The computer 1312 can connect to other devices/networks by way of antenna, port, network interface adaptor, wireless access point, modem, and/or the like.

The computer 1312 is operable to communicate with any wireless devices or entities operatively disposed in wireless communication, e.g., a printer, scanner, desktop and/or portable computer, portable data assistant, communications satellite, user equipment, cellular base device, smartphone, any piece of equipment or location associated with a wirelessly detectable tag (e.g., scanner, a kiosk, news stand, restroom), and telephone. This includes at least WiFi and Bluetooth® wireless technologies. Thus, the communication can be a predefined structure as with a conventional network or simply an ad hoc communication between at least two devices.

WiFi allows connection to the Internet from a desired location (e.g., a vehicle, couch at home, a bed in a hotel room, or a conference room at work, etc.) without wires. WiFi is a wireless technology similar to that used in a cell phone that enables such devices, e.g., mobile phones, computers, etc., to send and receive data indoors and out, anywhere within the range of a base station. WiFi networks use radio technologies called IEEE 802.11 (a, b, g, etc.) to provide secure, reliable, fast wireless connectivity. A WiFi network can be used to connect communication devices (e.g., mobile phones, computers, etc.) to each other, to the Internet, and to wired networks (which use IEEE 802.3 or Ethernet). WiFi networks operate in the unlicensed 2.4 and 5 GHz radio bands, at an 11 Mbps (802.11a) or 54 Mbps (802.11b) data rate, for example, or with products that contain both bands (dual band), so the networks can provide real-world performance similar to the basic 10BaseT wired Ethernet networks used in many offices.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A wall switch box, comprising:

a voltage conversion component that generates a direct current (DC) voltage from an alternating current (AC) voltage that is higher in magnitude than the DC voltage;

a motion sensing component that uses the DC voltage to detect a motion of an object; and based on the motion, a security component that generates an alarm signal that has been encoded based on a binary key that has been manually programmed via a user interface of the wall switch box.

2. The wall switch box of claim 1, wherein the motion sensing component detects the motion using an infrared based sensor.

3. The wall switch box of claim 1, further comprising:

a power component that switches, from the wall switch box using the DC voltage based on the motion, the AC voltage from a first contact to a second contact.

4. The wall switch box of claim 3, wherein the second contact is electrically coupled to a light fixture.

5. The wall switch box of claim 3, wherein the power component switches the AC voltage from the first contact to the second contact based on a detected contact of a switch electrically coupled to the DC voltage.

6. The wall switch box of claim 1, wherein the motion sensing component detects the motion using an ultrasonic based sensor.

7. The wall switch box of claim 1, wherein the user interface comprises a pushbutton switch.

8. The wall switch box of claim 1, further comprising:

a wireless transmitter component that wirelessly transmits, using the DC voltage, the alarm signal from the wall switch box.

9. The wall switch box of claim 8, further comprising:

a video camera that generates, using the DC voltage, data based on the motion, wherein the wireless transmitter component wirelessly transmits, using the DC voltage, the data from the wall switch box.

10. The wall switch box of claim 8, further comprising:

a microphone that generates, using the DC voltage, data based on the motion, wherein the wireless transmitter component wirelessly transmits, using the DC voltage, the data from the wall switch box.

11. A wall switch plate, comprising:

a first switch that is electrically coupled to a direct current (DC) voltage and activates, using the DC voltage based on a detected contact of the first switch, a relay within a wall switch box that switches an alternating current (AC) voltage from a first contact to a second contact, wherein the DC voltage has been generated by the AC voltage within the wall switch box, and wherein a first magnitude of the AC voltage is greater than a second magnitude of the DC voltage;

an opening corresponding to a portion of a motion sensing component that detects, from the wall switch box using the DC voltage, a motion of an object;

a security component that generates, based on the motion using the DC voltage, an alarm signal; and an encoder component that encodes, using the DC voltage via an interface of the wall switch box, the alarm signal based on a defined binary key.

12. The wall switch plate of claim 11, further comprising:

a translucent portion corresponding to a light emitting diode that emits, using the DC voltage, light based on the motion.

13. The wall switch plate of claim 12, further comprising a second switch that electrically couples the DC voltage to the light emitting diode based on a detected contact of the second switch.

14. The wall switch plate of claim 11, wherein the interface comprises a second switch.

15. An apparatus, comprising:

a voltage conversion component that generates a direct current (DC) voltage from an alternating current (AC) voltage that is higher in magnitude than the DC voltage; and an alarm component that:

wirelessly receives, using the DC voltage, an alarm signal from a motion sensing component of a wall switch box based on a motion detected by the motion sensing component, wherein the alarm signal has been encoded, via a user interface of the wall switch box, with a binary key; and generates an alarm output representing the alarm signal in response to a determination that the binary key satisfies a defend condition with respect to a keyword of the apparatus.

16. The apparatus of claim 15, wherein the alarm component activates a light emitting diode based on the alarm output.

17. The apparatus of claim 15, wherein the alarm component generates the alarm output in response to a determination that an input representing a deactivation of the alarm has not been received.

18. The apparatus of claim 15, further comprising:

a wireless transceiver component that wirelessly transmits, using the DC voltage, data based on the alarm output.

19. The apparatus of claim 18, wherein the alarm component wirelessly receives, using the DC voltage, the data from the motion sensing component of the wall switch box, and wherein the data comprises video information.

20. The apparatus of claim 18, wherein the alarm component wirelessly receives, using the DC voltage, the data from the motion sensing component of the wall switch box, and wherein the data comprises audio information.

* * * * *